US009175537B2

(12) United States Patent
Gette et al.

(10) Patent No.: US 9,175,537 B2
(45) Date of Patent: Nov. 3, 2015

(54) SEMI-RIGID LOCKDOWN DEVICE

(71) Applicant: Vetco Gray Inc., Houston, TX (US)

(72) Inventors: Nicholas Peter Gette, Houston, TX (US); David Lawrence Ford, Houston, TX (US); Michael Benjamin Snyder, Houston, TX (US)

(73) Assignee: Vetco Gray Inc., Houston, TX (US)

( * ) Notice: Subject to any disclaimer, the term of this patent is extended or adjusted under 35 U.S.C. 154(b) by 336 days.

(21) Appl. No.: 13/644,914

(22) Filed: Oct. 4, 2012

(65) Prior Publication Data

US 2014/0096977 A1 Apr. 10, 2014

(51) Int. Cl.
*E21B 33/03* (2006.01)
*E21B 33/038* (2006.01)
*E21B 33/04* (2006.01)

(52) U.S. Cl.
CPC ..... *E21B 33/03* (2013.01); *E21B 33/038* (2013.01); *E21B 33/04* (2013.01)

(58) Field of Classification Search
CPC ..... E21B 33/03; E21B 33/038
USPC ..... 166/379, 382, 387, 208
See application file for complete search history.

(56) References Cited

U.S. PATENT DOCUMENTS 4,757,860 A 7/1988 Reimert
5,060,724 A 10/1991 Brammer et al.
5,129,660 A 7/1992 Taylor et al.
5,307,879 A 5/1994 Kent
6,581,691 B1 6/2003 Jennings et al.
8,136,604 B2 * 3/2012 Jennings ..... 166/382
2010/0276162 A1 11/2010 Nelson
2012/0085554 A1 * 4/2012 Gette et al. ..... 166/387
2012/0227988 A1 * 9/2012 Nelson ..... 166/387

OTHER PUBLICATIONS

International Search Report and Written Opinion issued in connection with corresponding PCT Application No. PCT/US2013/063179 dated Jul. 1, 2014.

* cited by examiner

*Primary Examiner* — Brad Harcourt
(74) *Attorney, Agent, or Firm* — Bracewell & Giuliani LLP

(57) ABSTRACT

A wellhead seal assembly that forms a metal-to-metal seal between inner and outer wellhead members. A seal member has inner and outer seal legs separated by a slot. A locking ring is positioned in the outer seal leg and has wickered sections, where each of the wickered sections protrude through a window in the outer seal leg of the seal member. An energizing ring has an upper tapered surface that is oblique to an axis of the annular energizing ring and extending laterally from the axis over a portion of the locking ring and a lower tapered surface that is oblique to and extending laterally from the axis. As the energizing ring is moved into the slot, the upper tapered surface engages an inner surface of the locking ring, and the lower tapered surface engages an inner annular wall of the slot.

14 Claims, 2 Drawing Sheets

SEMI-RIGID LOCKDOWN DEVICE

FIELD OF THE INVENTION

This invention relates in general to wellhead assemblies and in particular to a semi-rigid lockdown device that includes a split locking ring that minimizes fretting of the seal surfaces due to movement while the lockdown device is energized.

BACKGROUND OF THE INVENTION

Seals are used between inner and outer wellhead tubular members to contain internal well pressure. The inner wellhead member may be a casing hanger located in a wellhead housing that supports a string of casing extending into the well. A seal or packoff seals between the casing hanger and the wellhead housing. Alternatively, the inner wellhead member could be a tubing hanger that supports a string of tubing extending into the well for the flow of production fluid. The tubing hanger lands in an outer wellhead member, which may be a wellhead housing, a Christmas tree, or a tubing head. A packoff or seal seals between the tubing hanger and the outer wellhead member. In addition to the seal between the inner and outer wellhead members, another annular seal, or emergency seal, may be located below this seal.

A variety of annulus seals of this nature have been employed. Conventional annulus seals include, for example, elastomeric and partially metal and elastomeric rings. Prior art seal rings made entirely of metal for forming metal-to-metal seals are also employed. The seals may be set by a running tool or they may be set in response to the weight of the string of casing or tubing. One type of metal-to-metal seal has inner and outer walls separated by a conical slot. An energizing ring is pushed into the slot to deform the inner and outer walls apart into sealing engagement with the inner and outer wellhead members. The energizing ring is a solid wedge-shaped member. The deformation of the inner and outer walls exceeds the yield strength of the material of the seal ring, making the deformation permanent.

Thermal growth between the casing or tubing and the wellhead may occur. The well fluid flowing upward through the tubing heats the string of tubing, and to a lesser degree the surrounding casing. The temperature increase may cause the tubing hanger and/or casing hanger to move axially a slight amount relative to the outer wellhead member or each other. During the heat up transient, the casing hanger and/or tubing hanger can also move radially due to temperature differences between components and the different rates of thermal expansion from which the component materials are constructed. If the seal has been set as a result of a wedging action where an axial displacement of energizing rings induces a radial movement of the seal against its mating surfaces, then sealing forces may be reduced if there is movement in the axial direction due to pressure or thermal effects. A reduction in axial force on the energizing ring results in a reduction in the radial inward and outward forces on the inner and outer walls of the seal ring, which may cause the seal to leak. A loss of radial loading between the seal and its mating surfaces due to thermal transients may also cause the seal to leak.

A need exists for a technique that addresses the seal leakage problems described above. In particular a need exists for a technique to provide a seal that minimizes fretting of the seal surfaces due to movement while the lockdown device is energized.

BRIEF DESCRIPTION OF THE INVENTION

In an embodiment of the present technique, a wellhead seal assembly is provided that forms a metal-to-metal seal between inner and outer wellhead members. A seal member has inner and outer seal legs separated by a slot. A locking ring is positioned in the outer seal leg and has wickered sections, where each of the wickered sections protrude through a window in the outer seal leg of the seal member. An energizing ring has an upper tapered surface that is oblique to an axis of the annular energizing ring and extending laterally from the axis over a portion of the locking ring and a lower tapered surface that is oblique to and extending laterally from the axis. As the energizing ring is moved into the slot, the upper tapered surface engages an inner surface of the locking ring, and the lower tapered surface engages an inner annular wall of the slot.

In an example embodiment, the wellhead seal assembly further includes a spring element (e.g., a c-ring, a wave spring, a belleville disk, a crush tab, etc.) positioned underneath at least one of the wickered sections in a corresponding window of the outer seal leg, where the spring element is compacted when the wickered section engages the inner wellhead member. The inner wellhead member may have an inner surface with wickers for contacting the wickered section of the locking ring when the energizing ring is moved into the slot.

In an example embodiment, the locking ring is a c-ring having open ends that are positioned behind solid webbing of the seal member, the solid webbing being between neighboring windows of the outer seal leg. The wickered sections of the locking ring may have a groove pitch in a range of about 3.175 mm to 12.7 mm.

Because multiple shoulders are engaged in the locking profile of the wickers, increased lockdown capacity is advantageously achieved in the bore of wellhead housing. Further, the fitting of the locking ring into the milled windows of the seal ring advantageously decreases the risk of premature actuation or stripping of the locking ring. The relatively fine groove pitch of the locking profile provides a semi-rigid lock that minimizes fretting of the seal ring and locking ring due to movement occurring while seal assembly is energized.

DETAILED DESCRIPTION OF THE INVENTION

Figure 1:
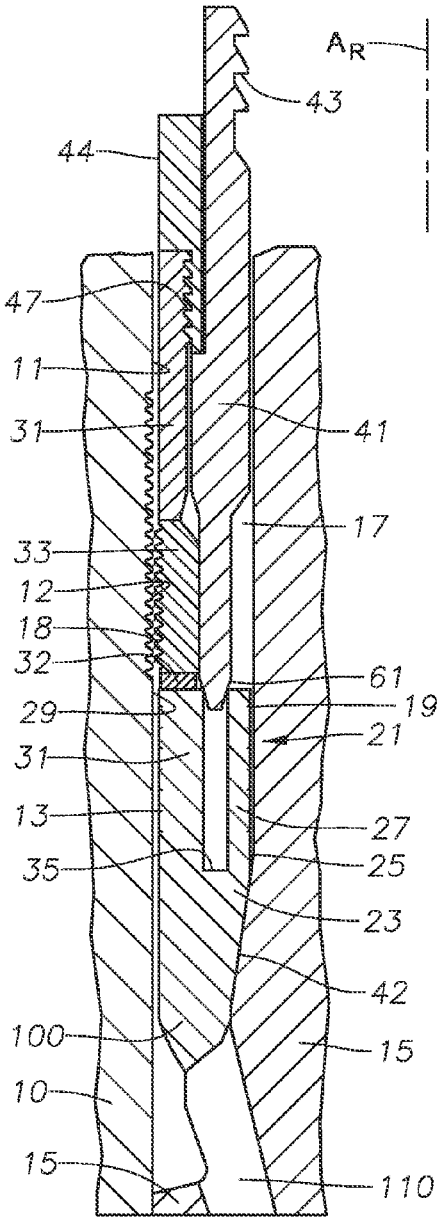
FIG. 1 is a sectional view of a seal assembly being lowered between outer and inner wellhead members, in accordance with an embodiment of the invention.

Referring to FIG. 1, an embodiment of the invention shows a portion of a wellhead assembly that includes high pressure wellhead housing 10. In this example, housing 10 is located at an upper end of a well and serves as an outer wellhead member of the wellhead assembly. Housing 10 has bore 11 located therein. In this example, an inner wellhead member is casing hanger 15, which is shown partially in FIG. 1 within bore 11. Alternately, wellhead housing 10 can be a tubing spool or a Christmas tree, and casing hanger 15 can instead be a tubing hanger, plug, safety valve, or other device. Casing hanger 15 has an exterior annular recess radially spaced inward from bore 11 to define seal pocket 17.

Continuing to refer to FIG. 1, metal-to-metal seal assembly 21 is lowered between housing 10 and casing hanger 15 and located in seal pocket 17. Seal assembly 21 includes seal ring 23 formed of a metal such as steel. Seal ring 23 has inner wall surface 25 comprised of inner seal leg 27 for sealing against the cylindrical wall of casing hanger 15. Seal ring 23 has outer wall surface 29 comprised of outer seal leg 31 that seals against wellhead housing bore 11. In some embodiments, the inner and outer walls 25, 29 can include interruptions 13, 19 (e.g., indentations, O-ring slots, etc.) to alter the characteristics of a seal formed by the seal ring 23 in the annular space. In this case, the interruptions 13, 19 can provide a disruption in contact pressure to thereby concentrate the pressure over a smaller band to form a more robust seal.

In the example embodiment of FIG. 1, seal ring 23 is uni-directional, having an upper section only; however, a seal ring that is bi-directional may optimally be used. The upper section has slot 35 that is formed by inner and outer surfaces that comprise generally cylindrical surfaces, which when viewed in an axial cross-section are generally parallel and each follow a straight line. The upper section also has a set of milled windows occurring at regular intervals along the bottom perimeter of the outer seal leg 31. Locking ring 33 (e.g., a c-ring) is positioned in outer seal leg 31 such that a set of wickered sections of locking ring 33 protrude through the set of milled windows. Features of the locking ring 33 are discussed in more detail in the description of FIGS. 3 and 4.

Crush washer 32 is positioned below locking ring 33 in the milled windows 34 to ensure that wickers 18 on locking ring 33 can fully engage wickers 12 of wellhead housing 10 radially. In other embodiments, an alternative spring element such as a wave spring, a belleville disk, or a crush tab may be used instead of crush washer 32 to allow for full radial engagement of wickers 12, 18. Wickers 12, 18 may include triangular grooves parallel to each other. In other embodiments, wickers 12, 18 may include helical, concentric grooves, which are triangular in configuration.

Annular energizing ring 41 engages slot 35 on the upper side. As shown, energizing ring 41 has an axis $A_R$ that is substantially parallel with an axis (not shown) of the wellhead assembly. Energizing ring 41 is forced downward into slot 35 by a running tool (not shown) connected to grooves 43 on the inner diameter of upper energizing ring 41 during setting. Alternatively, seal assembly 21 and energizing ring 41 may be part of a string that is lowered into bore 11, the weight of which forces energizing ring 41 into slot 35. If retrieval is required, the grooves 43 can be engaged by a retrieving tool (not shown) to pull energizing ring 41 from the set position. Energizing ring 41 can be formed of metal, such as steel.

Still primarily referring to FIG. 1, seal ring 23 includes outer seal leg 31 that includes an upper end that terminates in a threaded fitting 47 with an extension member or annular nut 44. Annular nut 44 can comprise resilient load-bearing material, examples of which include steel, metal alloys, and composites. Seal ring 23 may be comprised of metal, soft metal, or an elastomeric material. Outer seal leg 31 extends upward along the inner diameter surface of wellhead housing 10. Outer seal leg 31 includes a set of milled windows occurring at regular intervals along the bottom perimeter of outer seal leg 31. The milled windows of outer seal leg 31 are separated by sections of solid webbing (not shown in FIGS. 1 and 2).

Seal assembly 21 further includes locking ring 33 formed of a metal such as steel. Locking ring 33 is a locking member having several turned grooves in its outer diameter. The outer perimeter of locking ring 33 includes a set of milled slots to form raised wickered sections along the outer perimeter of locking ring 33. Locking ring 33 is positioned in the seal assembly 21 such that the set of wickered sections protrude through the set of milled windows of outer seal leg 31 and such that the milled slots are positioned behind the sections of solid webbing of outer seal leg 31.

Wickers 12, 18 are located on an inner wall surface of wellhead housing 10 and an outer wall surface of locking ring 33, respectively. In this example, the profiles of each set of wickers 12, 18 are shown as continuous profiles; however, wickers 12, 18 may be configured in other arrangements. Wickers 12, 18 of each of the wall surfaces engage each other as the seal assembly 21 is energized. Wickers 12, 18 enhance the grip to aid in the prevention of axial movement of seal ring 23 once set.

Seal ring 23 further includes inner seal leg 27 shown spaced laterally from outer seal leg 31 and above lower extension 100. Outer seal leg 31 and inner seal leg 27 are substantially perpendicular to the axis of the wellhead assembly. The casing hanger 15 has conical portion 42 that is engaged by a lower portion of inner seal leg 27.

Figure 2:
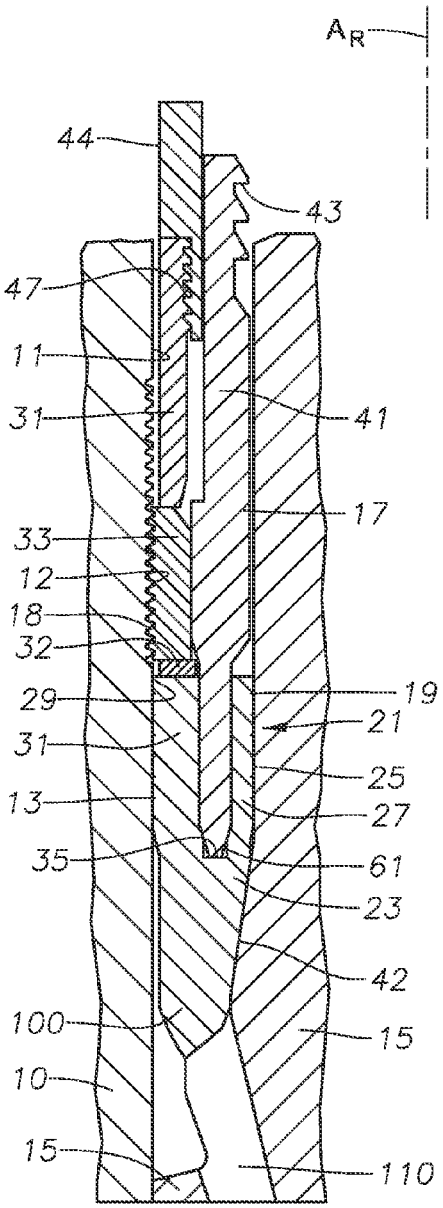
FIG. 2 is a sectional view of the seal assembly of FIG. 1 landed between outer and inner wellhead members in a set position, in accordance with an embodiment of the invention.

Referring now to FIG. 2, energizing ring 41 is put in a set position by downwardly pushing energizing ring 41 into slot 35 of seal ring 23. Energizing ring 41 has a nose 61 or engaging portion that engages slot 35. Specifically, energizing ring 41 has inner and outer surfaces for engaging the opposite inner sidewalls of slot 35 in seal ring 23 as shown in FIG. 2. The inner and outer surfaces may be straight surfaces as shown or optimally curved surfaces.

In the example embodiment of FIG. 1, lower extension 100 of seal ring 23 extends down and rests on a shoulder of the casing hangar 15. The casing hanger 15 has a set of flowby holes 110 positioned at regular intervals along the perimeter of the shoulder of casing hanger 15, where the flowby holes 110 permit flowby during running and cementing operations after the casing hanger 15 has been landed.

Energizing ring 41 may have upper tapered surface resting on an upper end of locking ring 33 and lower tapered surface at the lower end of nose 61, which may also have a vent to prevent hydraulic locking. The inner surface of locking ring 33 has an upward facing, tapered shoulder at its upper end, and the inner and outer legs 27, 31 of the seal ring 23 have tapered, upward facing shoulders at their upper ends that are proximate to the opening of the slot 35. When locking ring 33 and seal ring 23 are in unset positions, the shoulder of locking ring 33 forms a corresponding surface on which upper tapered surface of the energizing ring 41 rests, and the shoulders of the inner and outer legs 27, 31 form a corresponding surface on which lower tapered surface of the nose 61 rests.

As force is applied to energizing ring 41, upper tapered surface of the energizing ring 41 engages the shoulder of locking ring 33 to thereby drive locking ring 33 radially outward against the inner wall surface of wellhead housing 10. Specifically, wickers 18 of locking ring 33 are driven into wickers 12 on the inner wall surface of wellhead housing 10. Crush washer 32 is positioned below locking ring 33 in the milled windows 34 to ensure that the wicker 18 on the locking ring 33 can fully engage wickers 12 of wellhead housing 10 radially. In other embodiments, a wavespring, a belleville disk, or a crush tab may be used instead of crush washer 32 to allow for full radial engagement of wickers 12, 18. If the tips of wickers 18 of locking ring 33 strike the downward facing tapered surfaces of wickers 12 on wellhead housing 10, crush washer 32 collapses axially to thereby allow the locking ring 33 to fully expand into the inner surface of wellhead housing 10. Otherwise, if the tips of wickers 18 of locking ring 33 strike the upward facing tapered surfaces of wickers 12 on wellhead housing 10 or if wickers 12, 18 strike tip-to-tip, the locking ring 33 may displace upward from the crush washer 32 as wickers 18 of locking ring 33 fully engage wickers 12 of wellhead housing 10 radially. Additionally, nose 61 enters slot 35 and thereby deforms the legs 27, 31 of seal ring 23 against the walls of housing 10 and casing hanger 15 as downward axial force is applied to energizing ring 41.

Figure 3:
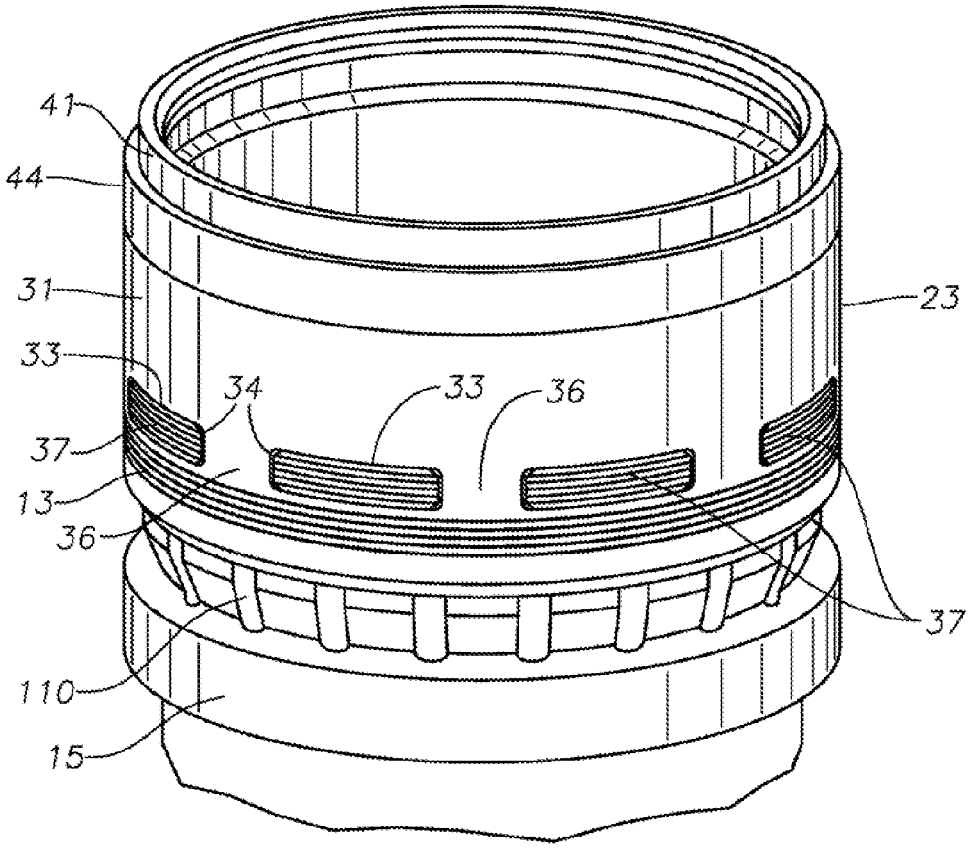
FIG. 3 is a perspective view of the of the seal assembly of FIG. 1, in accordance with an embodiment of the invention.

Referring to FIG. 3, a perspective view of seal assembly 21 positioned on casing hanger 15 is shown. Outer seal leg 31 includes milled windows 34 occurring at regular intervals along the bottom perimeter of outer seal leg 31. Between each of the milled windows 34 are sections of solid webbing 36. Locking ring 33 is positioned in the bottom perimeter of outer seal leg 31 such that wickered sections 37 protrude through a matching number of milled windows 34. When placed in the outer seal leg 31, locking ring 33 has milled slots that are positioned behind sections of solid webbing 36 along the bottom perimeter of outer seal leg 31. In one embodiment, locking ring 33 is split at one of its milled sections so that, when installed, the two free ends of locking ring 33 are positioned behind one of the sections of solid webbing 36. In this case, the section of solid webbing 36 prevents the two free ends of locking ring 33 from being unintentionally removed from the seal assembly 21 when actuating the locking ring 33 into the set position.

In an example operation of the embodiment shown in FIGS. 1-3, a running tool or string (not shown) is attached to seal assembly 21 (FIG. 1) and lowered into the seal pocket 17. Seal assembly 21 may be pre-assembled with energizing ring 41, annular nut 44, seal ring 23, and locking ring 33, all connected as shown in FIG. 1. The running tool or string (not shown) can be attached to grooves 43 on energizing ring 41. In this example, an inner wall surface of wellhead housing 10 and an outer wall surface of locking ring 33 have wickers 12, 18, respectively. The energizing ring 41 is pushed downward (such as by the running tool) with sufficient force such that upper tapered surface of the energizing ring 41 transmits force to the inner surface of locking ring 33. Insertion of energizing ring 41 causes locking ring 33 to move radially outwards such that wickers 18 lockingly engage wickers 12 of wellhead housing 10. Once embedded, wickers 12, 18 lock locking ring 33 and seal ring 23 into place to thereby minimize axial movement of seal ring 23. Those skilled in the art will appreciate that various configurations (e.g., different quantities of wickers, various metal compositions, etc.) of wickers 12, 18 can be used to modify the characteristics of their locking feature. In some embodiments, the energizing ring 41 may be configured with a small amount of radial interference between the inner surface of locking ring 33 and the outer surface of the casing hanger 15 thereby creating a stiff radial support that resists disengagement of the locking profile when subject to an upward axial load.

As nose 61 of energizing ring 41 engages slot 35, inner wall 25 of inner seal leg 27 engages the outer wall of casing hanger 15, and outer wall 29 of outer seal leg 31 engages the inner wall of wellhead housing 10. The inner and outer walls 25, 29 form a seal in the annular space between the casing hanger 15 and the wellhead housing 10.

Because multiple shoulders are engaged in the locking profile of the wickers 12, 18, increased lockdown capacity is achieved in the bore 11 of wellhead housing 10. Further, the fitting of locking ring 33 in milled windows 34 of seal ring 23 decreases the risk of premature actuation or stripping of locking ring 33. In this example, the locking profile of wickers 12, 18 is shown with a 3.175 mm groove pitch. The relatively fine groove pitch of the locking profile provides a semi-rigid lock that minimizes fretting of the seal ring 23 and locking ring 33 due to movement occurring while seal assembly 23 is energized, which improves seal life. In some embodiments, a wider range of axial uncertainty can be accommodated for by using a larger groove pitch for the locking profile (e.g., 12.7 mm).

Subsequently, during production, hot well fluids may cause the casing to grow axially due to thermal growth. If so, casing hanger 15 may move upward relative to wellhead housing 10. Inner seal leg 27 will move upward with casing hanger 15 and relative to outer seal leg 31. Wickers 12, 18 will maintain locking engagement between the inner surface of wellhead housing 10 and the outer surface of locking ring 33.

In the event that seal assembly 21 is to be removed from bore 11, a running tool is connected to threads 43 on upper energizing ring 41. An upward axial force is applied to upper energizing ring 41, causing it to withdraw from slot 35. In this case, once annular nut 44 is engaged by the energizing ring 41, the upward axial force withdraws seal assembly 21 from bore 11.

In an additional embodiment (not shown), wellhead housing 10 can be a tubing spool or a Christmas tree. Furthermore, casing hanger 15 can instead be a lockdown hanger, tubing hanger, plug, safety valve or other device.

Figure 4:
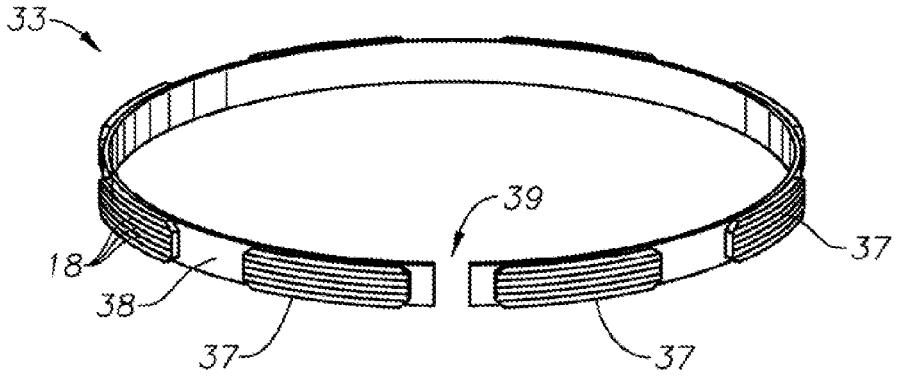
FIG. 4 is a perspective view of a c-ring of a seal assembly, in accordance with an embodiment of the invention.

Referring to FIG. 4, a perspective view of an example locking ring 33 is shown. Locking ring 33 may be positioned in the outer seal leg of a seal ring as discussed in FIGS. 1-3. Locking ring 33 has milled slots 38 defining wickered sections 37 of the wickers (i.e., curved grooves) 18 formed in the outer perimeter of locking ring 33. Locking ring 33 may also have open ends 39 at one of milled slots 38.

While a semi-rigid lockdown device has been shown in only one of its forms, it should be apparent to those skilled in the art that it is not so limited but is susceptible to various changes without departing from the scope of the invention. For example, while the embodiments above are described with respect to a housing and casing hanger, the seal may be configured to be used in various annular spaces (e.g., between nested casing hangers) of a wellhead assembly.

What is claimed is:

1. A wellhead assembly comprising:

an outer wellhead member having a bore axially extending therein;

an inner wellhead member positioned in the bore of the outer wellhead member;

an annular space positioned between an outer wall portion of the inner wellhead member and an inner wall portion of the outer wellhead members;

a seal member having a cylindrical wall containing windows circumferentially spaced apart from each other around a circumference of the cylindrical wall;

a locking ring carried on an inner diameter surface of the cylindrical wall, the locking ring having locking sections circumferentially spaced apart from each other around the locking ring, each of the locking sections being located in one of the windows;

the locking ring being radially expansible from a retracted position to an expanded position wherein outer surfaces of the locking sections protrude outward from the windows and engage the inner wall portion of the outer wellhead member, wherein the outer surfaces of the locking sections comprise wickers, and the inner wall portion of the outer wellhead member has wickers that are engaged by the wickers of the locking sections when the locking ring is in the expanded position;

an annular energizing ring carried by the seal member and being axially movable relative to the seal member and the locking ring from an upper run-in position to a lower set position, the energizing ring pushing the locking ring from the retracted position to the expanded position while moving from the run-in position to the set position; wherein each of the windows has a lower edge and an upper edge with an axial dimension measured between the lower edge and the upper edge; and each of the locking sections has a lower edge and an upper edge with an axial dimension measured between the lower edge and the upper edge of each of the locking sections that is less than the axial dimension of each of the windows by an amount sufficient to allow limited axial movement of the locking sections relative to the windows while the wickers of the locking sections are being pushed into engagement with the wickers of the outer wellhead member.

2. The wellhead assembly as claimed in claim 1, further comprising:

a plurality of axially deflectable spring elements, each of the spring elements being positioned between one of the edges of each of the windows and one of the edges of one of the locking sections.

3. The wellhead assembly as claimed in claim 1, wherein the axial movement of the energizing ring from the run-in position to the set position also deforms portions of the seal member into sealing engagement with the inner and outer wellhead members.

4. The wellhead assembly as claimed in claim 1, wherein the locking ring comprises a split ring.

5. The wellhead assembly as claimed in claim 1, wherein the locking ring comprises a c-ring having open ends located at a point on an inner surface of the cylindrical wall of the seal member that is between adjacent ones of the windows.

6. The wellhead assembly as claimed in claim 1, wherein the outer surfaces of the locking sections are flush with an outer diameter surface of the cylindrical wall of the seal member while the locking ring is in the retracted position.

7. A wellhead assembly comprising:

an outer wellhead member having a bore axially extending therein;

an inner wellhead member positioned in the bore of the outer wellhead member;

an annular space positioned between outer wall portions of the inner wellhead member and inner wall portions of the outer wellhead member, an annular locking profile formed on the inner wall portion of the outer wellhead member;

a seal member having a cylindrical outer seal leg and a cylindrical inner seal leg defining an annular slot therebetween, the outer seal leg having a set of windows circumferentially spaced apart from each other around a circumference of the outer seal leg;

a locking ring having a resilient, radially expansible band positioned around an inner diameter surface of the outer seal leg, the locking ring having locking sections circumferentially spaced apart from each other around the band, each of the locking sections having an outer surface that protrudes radially outward from the band and comprises a locking profile, each of the locking sections being located within one of the windows;

an annular energizing ring that is axially movable from an upper run in position to a lower set position, the energizing ring having an outer surface portion that engages the locking ring and pushes the outer surfaces of the locking sections radially outward from the windows into locking engagement with the locking profile of the outer wellhead member while the energizing ring is moving from the run-in to the set position;

the energizing ring having a lower portion that enters the slot and deforms the outer seal leg into sealing engagement with the inner wall portion of the outer wellhead member and deforms the inner seal leg into sealing engagement with the outer wall portion of the inner wellhead member; wherein each of the windows has a lower edge and an upper edge with an axial dimension measured between the lower edge and the upper edge; and each of the locking sections has a lower edge and an upper edge with an axial dimension measured between the lower edge and the upper edge of each of the locking sections that is less than the axial dimension of each of the windows by an amount sufficient to allow limited axial movement of the locking sections relative to the windows while the locking profiles of the locking sections are being pushed into engagement with the locking profile of the outer wellhead member.

8. The wellhead assembly as claimed in claim 7, wherein the locking profile of the outer wellhead member and the locking profiles of the locking sections comprise wickers.

9. The wellhead assembly as claimed in claim 7, further comprising:

a plurality of axially deflectable spring elements, each of the spring elements being positioned between one of the edges of each of the windows and one of the edges of one of the locking sections.

10. The wellhead assembly as claimed in claim 7, wherein the band of the locking ring is split and has open ends located at a point on the inner diameter surface of the outer seal leg that is between adjacent ones of the windows.

11. A method of installing a wellhead assembly, comprising:

(a) installing an outer wellhead member having a bore axially extending therein and providing an annular locking profile on the inner wall portion of the outer wellhead member;

(b) installing an inner wellhead member positioned in the bore of the outer wellhead member and located relative to the outer wellhead member such that an outer wall portion of the inner wellhead member and an inner wall portion of the outer wellhead member define an annular space;

(c) providing a seal assembly, the seal assembly comprising:

a seal member having a cylindrical wall containing windows circumferentially spaced apart from each other around a circumference of the cylindrical wall;

a locking ring carried on an inner diameter surface of the cylindrical wall, the locking ring having locking sections circumferentially spaced apart from each other around the locking ring, each of the locking sections being located in one of the windows and having locking profiles on outer surfaces of the locking sections; and an annular energizing ring carried by the seal ring;

(d) landing the seal assembly in the annular space;

(e) applying downward axial force to push the annular energizing ring downward, which pushes the locking sections radially outward from the windows into engagement with the inner wall portion of the outer wellhead member, engaging the locking profiles of the locking sections with the locking profile of the outer wellhead member, and allowing limited axial movement of the locking sections relative to the windows while engaging the locking profiles of the locking sections with the locking profile of the outer wellhead member.

12. The method as claimed in claim 11, wherein the downward axial force of step (e) also deforms the seal member into sealing engagement with the inner wall portion of the outer wellhead member and the outer wall portion of the inner wellhead member.

13. The method as claimed in claim 11, wherein step (c) comprises axially biasing each of the locking sections toward a circumferentially extending edge of each of the windows.

14. The method as claimed in claim 11, wherein:

step (c) occurs before step (e) and comprises positioning outer surfaces of the locking sections flush with an outer diameter surface of the cylindrical wall.

* * * * *